US007130799B1

(12) United States Patent
Amano et al.

(10) Patent No.: US 7,130,799 B1
(45) Date of Patent: Oct. 31, 2006

(54) SPEECH SYNTHESIS METHOD

(75) Inventors: Katsumi Amano, Tsurugashima (JP); Shisei Cho, Tsurugashima (JP); Soichi Toyama, Tsurugashima (JP); Hiroyuki Ishihara, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 959 days.

(21) Appl. No.: 09/684,331

(22) Filed: Oct. 10, 2000

(30) Foreign Application Priority Data

Oct. 15, 1999 (JP) ..... 11-294357

(51) Int. Cl.
*G10L 13/00* (2006.01)

(52) U.S. Cl. ..... 704/262

(58) Field of Classification Search ..... 704/261, 704/262, 268, 258
See application file for complete search history.

(56) References Cited

U.S. PATENT DOCUMENTS 6,438,522 B1 * 8/2002 Minowa et al. ..... 704/258

FOREIGN PATENT DOCUMENTS

| | | | |
|---|---|---|---|
| EP | 0 427 485 | A2 | 5/1991 |
| EP | 0427485 | A2 * | 5/1991 |
| WO | WO 96/27870 | A1 | 9/1996 |
| WO | WO 98/35340 | A2 | 8/1998 |

* cited by examiner

*Primary Examiner*—Angela Armstrong
(74) *Attorney, Agent, or Firm*—Sughrue Mion, PLLC

(57) ABSTRACT

A speech synthesizing method which synthesizes speech naturally is disclosed. Standardized frame power values of an n-th frame is calculated when frame power values at head and tail frames in a phoneme are standardized. An average value of the power values sampled from the power frequency characteristics in the n-th frame at a predetermined frequency interval is set as a mean frame power value. A sum of squares of signal levels in one frame of a frequency signal from a sound source is calculated as a frame power correction value. A speech envelope signal is calculated as a function having variables of the standardized frame power values, the frame power correction value and the mean frame power value. The speech envelope signal adjusts the amplitude level of a speech waveform signal supplied from a vocal tract filter according to the level of the speech envelope signal.

7 Claims, 6 Drawing Sheets

SPEECH SYNTHESIS METHOD

1. FIELD OF THE INVENTION

The present invention relates to a speech synthesis method for artificially generating speech waveform signals.

2. BACKGROUND OF THE RELATED ART

Speech waveforms of natural speech can be expressed by connecting basic units which are made by continuously connecting phonemes, one vowel (V) and one consonant (C) in a form such as "CV", "CVC" or "VCV".

Accordingly, a conversation can be created by means of synthetic speech by processing and registering such phonemes as data (phoneme data) in advance, reading out phoneme data corresponding to a conversation from the registered phoneme data in sequence, and generating sounds corresponding to respective read-out phoneme data.

To create a database based on the above-mentioned phoneme data, firstly, a given document is read by a person, and his/her speech is recorded. Then, speech signals reproduced from the recorded speech are divided into the above-mentioned phonemes. Various data indicative of these phonemes are registered as phoneme data. Then, in order to synthesize the speech, respective speech data is connected and supplied as a serial speech.

However, respective connected phonemes are segmented from the separately recorded speeches. Hence, irregularities exist in the vocal power with which the phonemes are uttered. Therefore, a problem arises that synthesized speech is unnatural when the uttered phonemes are merely connected together.

An object of the present invention is to provide a speech synthesizing method for generating natural sounding synthetic speech.

SUMMARY OF THE INVENTION

It is an object of the present invention to provide a method for synthesizing speech with an apparatus comprising a sound source for generating a frequency signal, a vocal tract filter for generating speech waveform signals by filtering the frequency signal with filter characteristics corresponding to a linear predictive coefficient based on respective phonemes.

In one aspect of the invention, a method comprises the steps of: dividing said phonemes into a plurality of frames having a predetermined time length, summing squares of speech samples in one of said plurality of frames for each frame as a frame power value, standardizing frame power values at head and tail frames in one phoneme to predetermined values, respectively, to obtain a frame power value of an n-th frame, summing squares of signal levels of a frame in said frequency signal to obtain a frame power correction value, providing a speech envelope signal by means of a function having variables of said standardized frame power values and said frame power correction value, and adjusting an amplitude level of said speech waveform signal as a function of the speech envelope signal.

As described above, the levels of the head and tail portions of respective phonemes are always maintained at predetermined levels without substantially deforming the synthesized speech waveform. Therefore, phonemes are connected together smoothly so that natural sounding synthesized speeches can be generated.

BRIEF DESCRIPTION OF THE DRAWINGS

The aforementioned aspects and other features of the invention are explained in the following description, taken in connection with the accompanying drawing figures wherein.

DETAILED DESCRIPTION OF THE INVENTION

Figure 1:
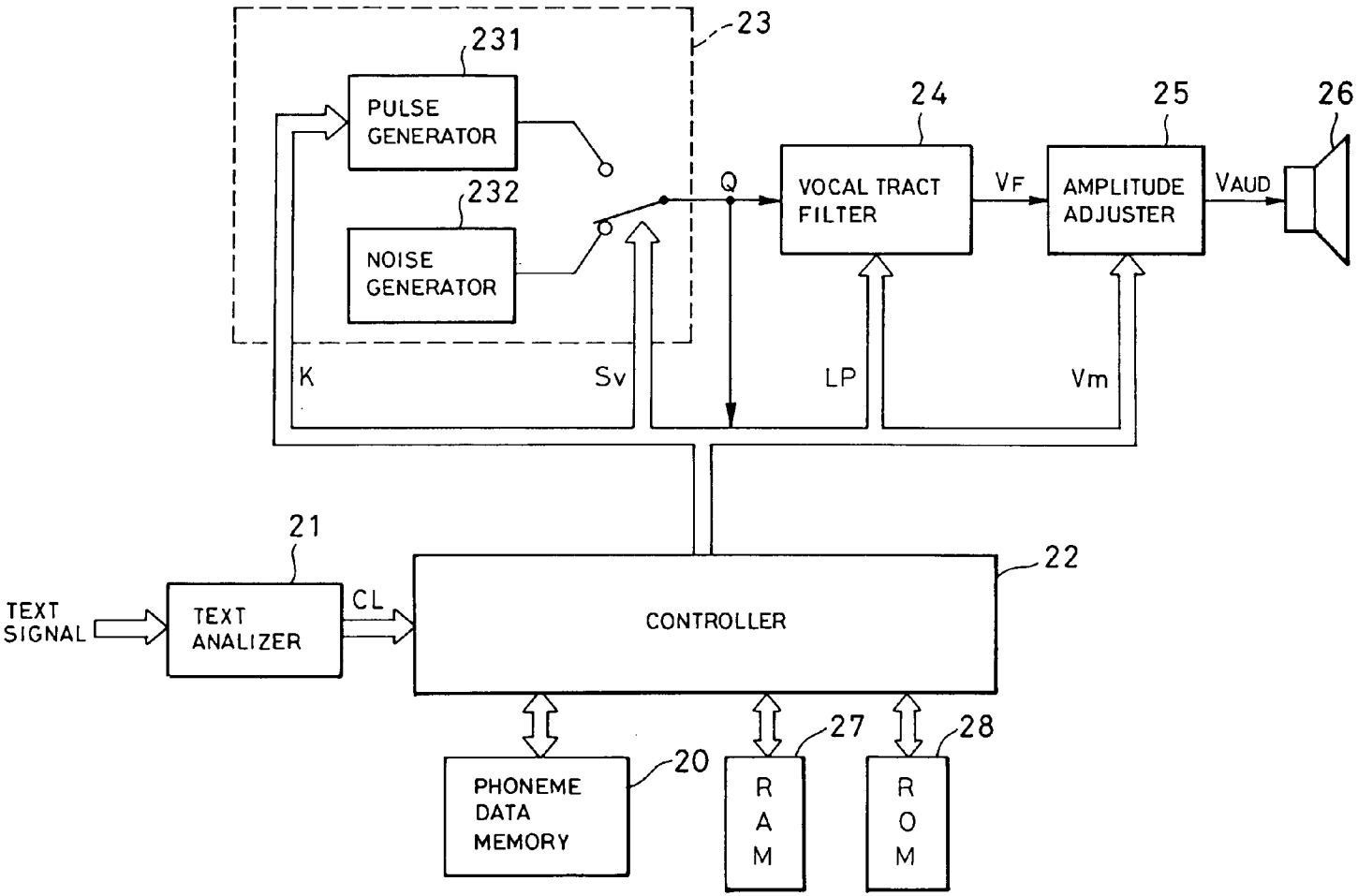
FIG. 1 is a block diagram showing a speech synthesis apparatus according to the present invention.

FIG. 1 is a block diagram showing a text speech synthesis device for reading a given document (text) by synthesizing the speech by means of a method according to the present invention.

In FIG. 1, a text analyzing circuit 21 generates intermediate language character string information including information such as accents and phrases peculiar to respective languages in a character string based on inputted text signals. The text analyzing circuit 21 then supplies intermediate language character string signals CL corresponding to the above information to a speech synthesis control circuit 22.

A phoneme data memory 20, a RAM (Random Access Memory) 27, and a ROM (Read Only Memory) 28 are connected to the speech synthesis control circuit 22.

The phoneme data memory 20 stores phoneme data corresponding to various phonemes which have been sampled from actual human voice, and speech synthesizing parameters (standardized frame power values and mean frame power values) used for the speech synthesis.

A sound source module 23 is provided with a pulse generator 231 for generating impulse signals having a frequency corresponding to a pitch frequency designating signal K supplied from the speech synthesis control circuit 22, and a noise generator 232 for generating noise signals carrying an unvoiced sound. The sound source module 23 alternatively selects the impulse signal and the noise signal in response to a sound source selection signal $S_v$ supplied from the speech synthesis control circuit 22. The sound source module 23 then supplies the selected signal as a frequency signal Q to a vocal tract filter 24.

The vocal tract filter 24 may include a FIR (Finite Impulse Response) digital filter, for example. The vocal tract filter 24 filters a frequency signal Q supplied from the sound source module 23 with a filtering coefficient corresponding to a linear predictive code signal LP supplied from the speech synthesis control circuit 22, thereby generating a speech waveform signal $V_F$.

An amplitude adjustment circuit 25 generates an amplitude adjustment waveform signal $V_{AUD}$ by adjusting the amplitude of a speech waveform signal $V_F$ to a level based on a speech envelope signal $V_m$ supplied from the speech synthesis control circuit 22. The amplitude adjustment circuit 25 then supplies the amplitude adjustment waveform signal $V_{AUD}$ to a speaker 26. The speaker 26 generates an acoustic output corresponding to the amplitude adjustment waveform signal $V_{AUD}$. That is, the speaker 26 generates the reading speeches based on the input text signals as explained hereinafter.

A method will be described hereinafter for generating the above-mentioned phoneme data and speech synthesis parameters stored in the phoneme data memory 20.

Figure 2:
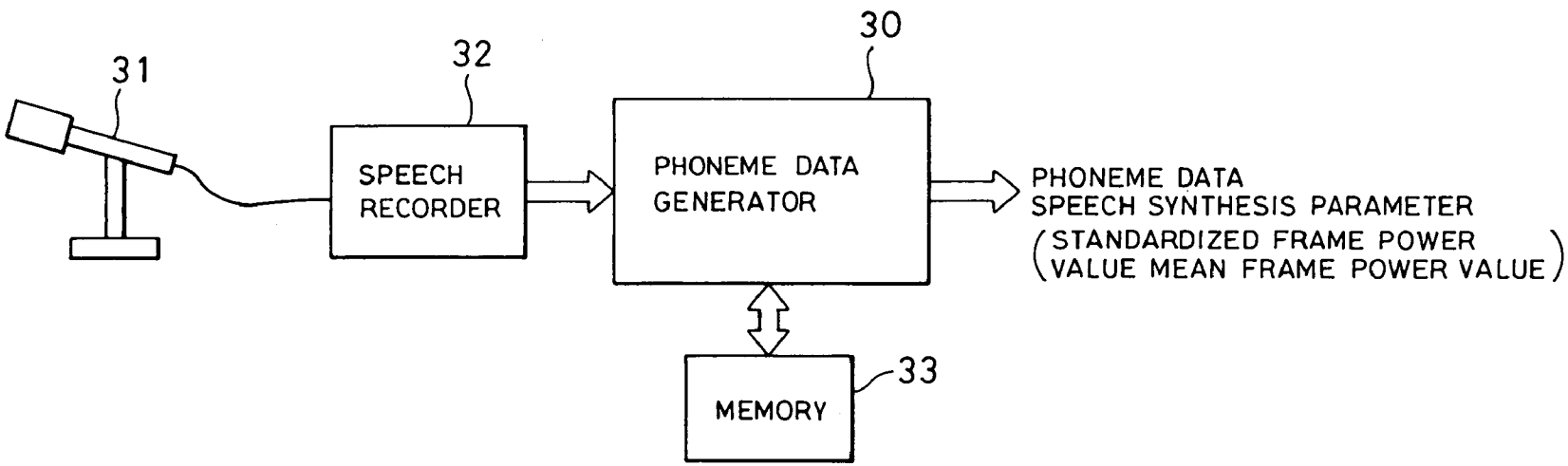
FIG. 2 is a block diagram showing an apparatus for generating phoneme data and speech synthesis parameters.

FIG. 2 is a block diagram showing an apparatus for generating speech synthesis parameters.

In FIG. 2, a speech recorder 32 records a human speech received by a microphone 31. The speech recorder 32 supplies speech signals reproduced from the recorded speech to a phoneme data generating device 30.

The phoneme data generating device 30 sequentially samples a speech signal supplied from the speech recorder 32 to generate a speech sample. The phoneme data generating device 30 then stores the signals in a predetermined domain in a memory 33. The phoneme data generating device 30 then executes steps for generating phonemes, as shown in FIG. 3.

Figure 3:
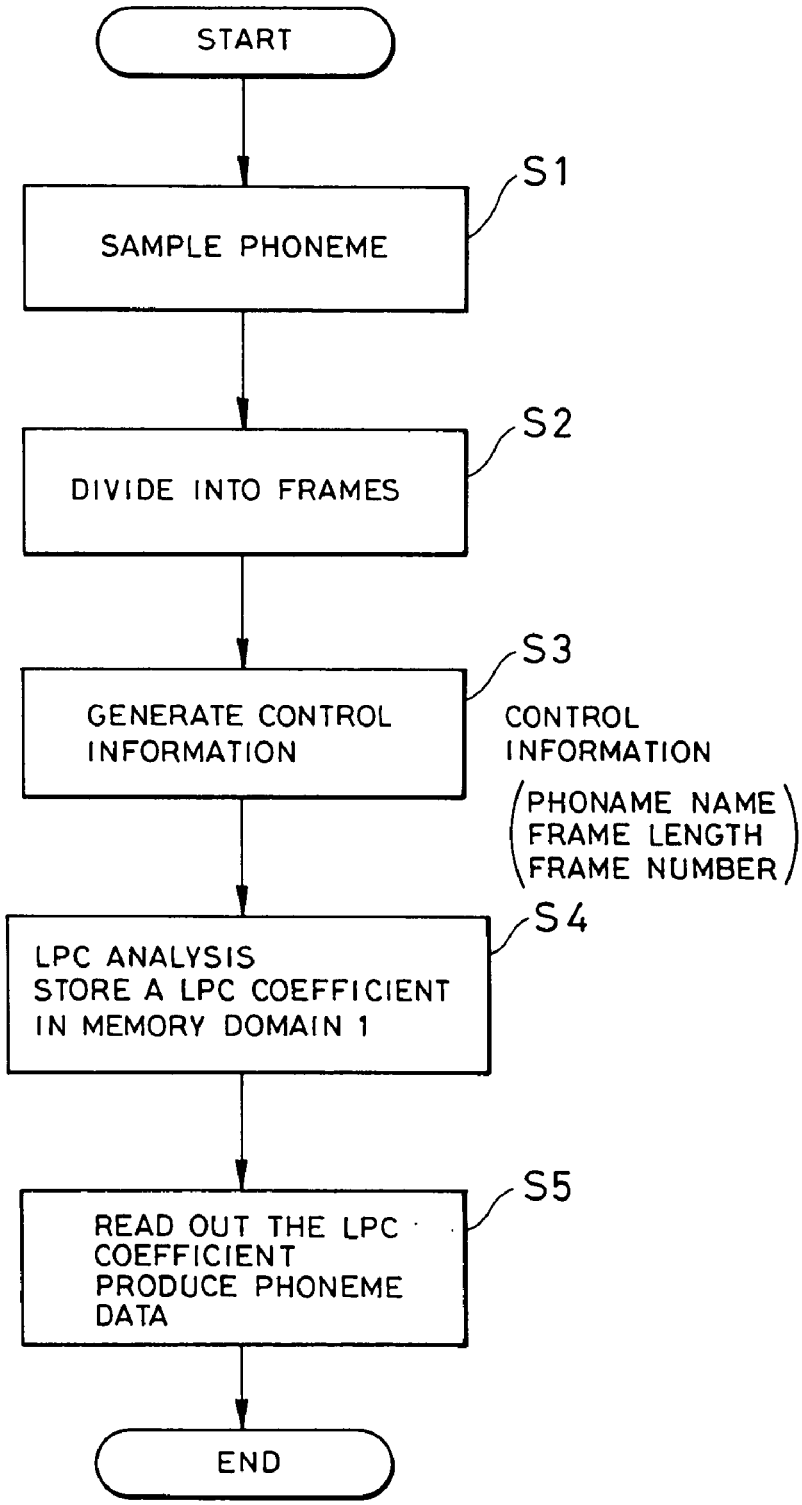
FIG. 3 is a flow chart showing steps for generating phoneme data.

In FIG. 3, the phoneme data generating device 30 reads out speech samples stored in the memory 33 in sequence. The phoneme data generating device 30 then divides the series of speech samples into phonemes such as "VCV" (step S1).

For example, a Japanese spoken phrase "mokutekichi ni" is segmented to mo/oku/ute/eki/iti/ini/i. The Japanese spoken phrase "moyosimono" is segmented to mo/oyo/osi/imo/ono/ono/o. The Japanese spoken phrase "moyorino" is segmented to mo/oyo/ori/ino/o. The Japanese spoken phrase "mokuhyono" is segmented to mo/oku/uhyo/ono/o.

Figure 4:
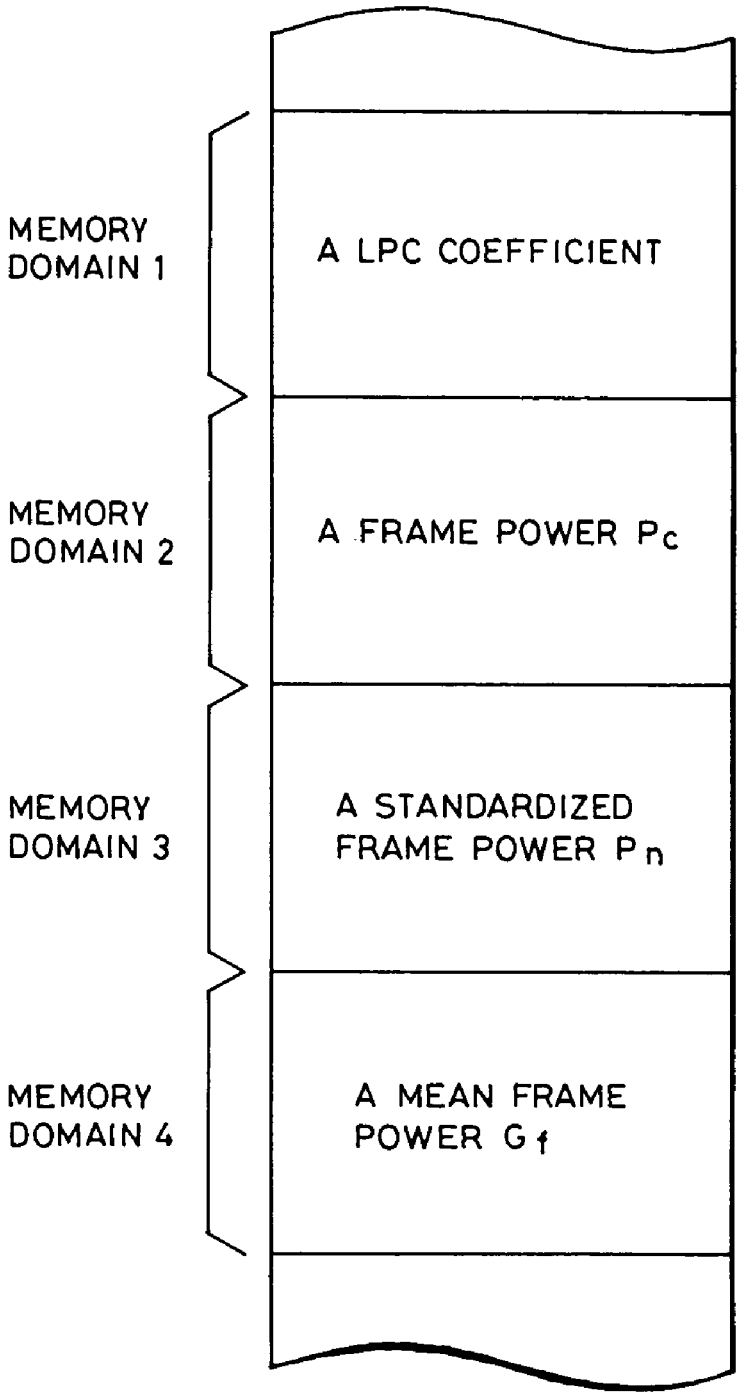
FIG. 4 is a view showing a memory map in a memory 33.

Subsequently, the phoneme data generating device 30 divides each segmented phoneme into frames of a predetermined length, for example, 10 ms (step S2). Control information including a name of the phoneme to which each frame belongs, a frame length of the phoneme, and the frame number is added to each divided frame. The above frame is then stored in a given domain of the memory 33 (step S3). Then, the phoneme data generating device 30 analyzes a linear predictive coding LPC on every frame with respect to the waveform of each phoneme to generate a linear predictive coding coefficient (hereinafter called "LPC coefficient") of 15 orders. The resultant coefficient is stored in a memory domain 1 of the memory 33 as shown in FIG. 4 (step S4). It should be noted that the resultant LPC coefficient in step S4 is a so-called speech spectral envelope parameter corresponding to a filter coefficient of the vocal tract filter 24. Subsequently, the phoneme data generating device 30 reads out the LPC coefficient in the memory domain 1 of the memory 33, and supplies the LPC coefficient as the phoneme data (step S5). This phoneme data is stored in the phoneme data memory 20.

Figure 5:
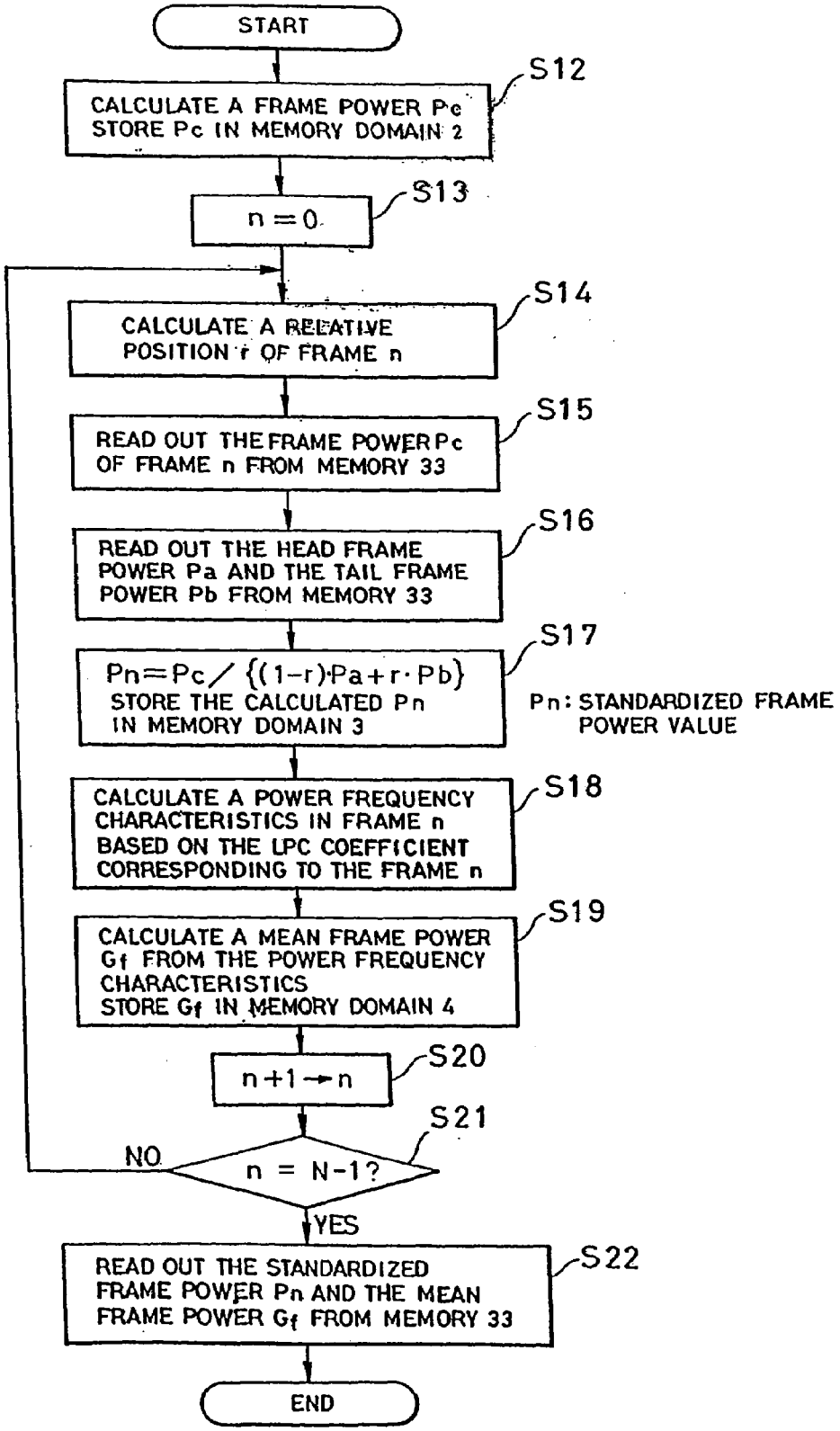
FIG. 5 is a flow chart showing steps for calculating speech synthesis parameters.

Then, the phoneme data generating device 30 calculates speech synthesis parameters as shown in FIG. 5 on respective phonemes stored in the memory 33.

In FIG. 5, the phoneme data generating device 30 calculates the sum of all squares of speech sample values in each frame in one phoneme that is subject to processing (hereinafter called "subject phoneme") in order to generate a speech power of the frame. Then, as shown in FIG. 4, the speech power is stored in a memory domain 2 of the memory 33 as a frame power PC (step S12).

Subsequently, the phoneme data generating device 30 stores "0" indicative of the head frame number in a built-in register n (not shown) (step S13). Then, the phoneme data generating device 30 generates the relative position in the subject phoneme of the frame n indicated by the frame number stored in the built-in register n (step S14). The relative position is expressed by the following formula:

$$r=(n-1)/N$$

wherein, r: relative position, and

N: the number of all frames in the subject phoneme.

Then, the phoneme data generating device 30 reads out the frame power PC in the frame n from the memory domain 2 of the memory 33 shown in FIG. 4 (step S15). The phoneme data generating device 30 reads out the frame powers corresponding to the head and tail frames of the subject phoneme as the head and tail frame powers $P_a$ and $P_b$, respectively, among the frame powers $P_c$ in the memory domain 2 (step S16).

Then, the phoneme data generating device 30 generates a standardized frame power $P_n$ in the frame n indicated by a built-in register n, by executing the following calculation (1) using the head and tail frame powers Pa, Pb, the frame power Pc obtained in step S15 and the relative position r.

$$P_n=P_c/[(1-r)P_a+rP_b] \quad (1)$$

Then, the phoneme data generating device 30 stores the standardized frame power Pn in a memory domain 3 of the memory 33 (step S17).

That is, the phoneme data generating device 30 generates the frame power value in the frame n when the frame power $P_c$ in the tail frame of this subject phoneme is set to "1".

Then, the phoneme data generating device 30 reads out the LPC coefficient corresponding to the frame n indicated by the built-in register n from the memory domain 1 of the memory 33 shown in FIG. 4. The phoneme data generating device 30 then generates power frequency characteristics in the frame n based on the LPC coefficient (step S18). Thereafter, the phoneme data generating device 30 samples a power value from the power frequency characteristics every predetermined frequency interval, and then stores the average value of these power values as a mean frame power $G_f$ in a memory domain 4 of the memory 33 shown in FIG. 4 (step S19).

Then, the phoneme data generating device 30 adds "1" to the frame number n stored in the built-in register n to generate a new frame number n, the new frame number n replacing the previous frame number n, and stores the new frame number n in the built-in register n by substitution (step S20). Subsequently, the phoneme data generating device 30 determines whether the frame number stored in the built-in register n equals (N−1) (step S21).

In step S21, if the frame number stored in the built-in register n does not equal (N−1), the phoneme data generating device 30 returns to the step S14, and repeats the above-mentioned operation. Such an operation stores the standardized frame power $P_n$ and the mean frame power $G_f$ corresponding to each of the head frame to $(N-1)^{th}$ frames of a subject phoneme in the memory domains 3 and 4, as shown in FIG. 4.

In the step S21, if the frame number stored in the built-in register n equals (N−1), the phoneme data generating device 30 respectively reads out the standardized frame power $P_n$ and the mean frame power $G_f$ stored in the memory domains 3 and 4 of the memory 33 shown in FIG. 4, and outputs the standardized frame power $P_n$ and the mean frame power $G_f$ (step S22). The standardized frame power $P_n$ and the mean frame power $G_f$ are stored in the phoneme memory 20 as speech synthesis parameters.

That is, the respective phoneme data obtained by the procedure shown in FIG. 3 is associated with the standardized frame power $P_n$ and the mean frame power $G_f$ obtained by the procedure shown in FIG. 5 to store the resultant data in the phoneme data memory 20.

The speech synthesis control circuit 22 shown in FIG. 1 receives the phoneme data and speech synthesis parameters corresponding to the intermediate language characters string signals CL from the text analyzing circuit 21, by using software stored in the ROM 28. The speech synthesis control circuit 22 then controls speech synthesis as explained hereinafter.

The speech synthesis control circuit 22 divides segments of the intermediate language characters string signals CL into phonemes consisting of "VCV", and then receives the phoneme data corresponding to respective phonemes from the phoneme data memory 20 sequentially. The speech synthesis control circuit 22 then supplies a pitch frequency designation signal K for designating the pitch frequency to the sound source module 23. Then, the speech synthesis control circuit 22 synthesizes the speech on respective phoneme data in order of the reading from the phoneme data memory 20.

Figure 6:
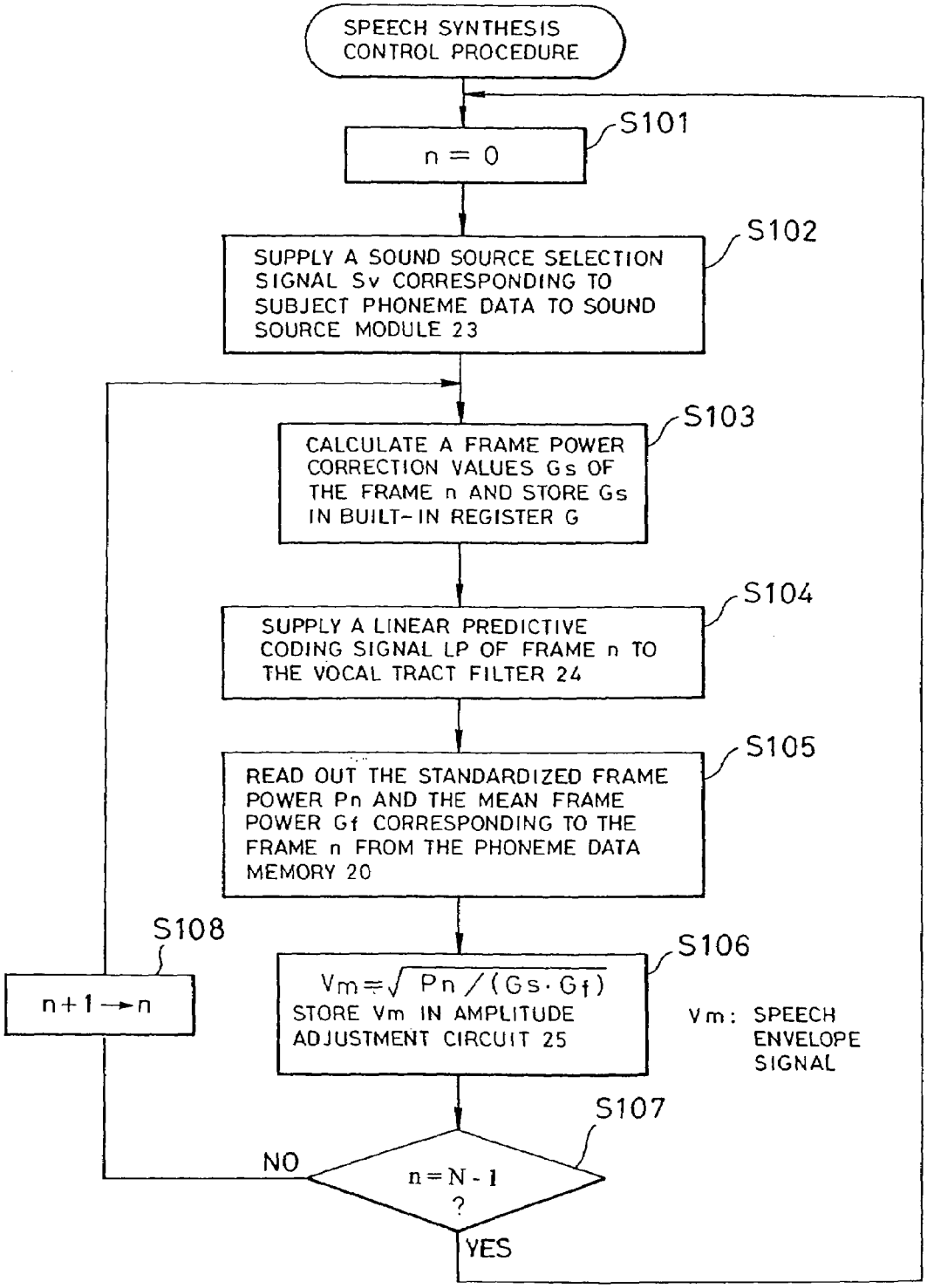
FIG. 6 is a view showing a speech synthesis control routine based on a speech synthesis method of the present invention.

FIG. 6 shows a speech synthesizing control procedure.

In FIG. 6, the speech synthesis control circuit 22 selects the data for one phoneme subject to be processed (hereinafter called "subject phoneme data) in the received order as mentioned above. The speech synthesis control circuit 22 then stores "0" indicative of the head frame number in the phoneme data in the built-in register n (not shown) (step S101). Subsequently, the speech synthesis control circuit 22 supplies a sound source selection signal $S_v$ to the sound source module 23 (step S102). The sound source selection signal $S_v$ indicates whether the phoneme corresponding to the above-mentioned subject phoneme data is a voiced sound or an unvoiced sound. Depending on the sound source selection signal $S_v$, the sound module 23 generates as a frequency signal Q one of a noise signal and an impulse signal having a frequency designated by the pitch frequency designation signal K.

Subsequently, the speech synthesis control circuit 22 samples the frequency signal Q supplied from the sound source module 23 for every predetermined interval. The control circuit 22 then calculates the sum of squares of respective sample values in a frame to generate a frame power correction value $G_s$. Then, the speech synthesis control circuit 22 stores the frame power correction value $G_s$ in a built-in register G (not shown) (step S103). Then, the speech synthesis control circuit 22 supplies the LPC coefficient to the vocal tract filter 24 as the linear predictive coding signal LP (step S104). It is noted that the LPC coefficient corresponds to the frame n indicated by the built-in register n in the subject phoneme data. Then, the speech synthesis control circuit 22 reads out the standardized frame power $P_n$ and the mean frame power $G_f$ corresponding to the frame n indicated by the above-mentioned built-in register n in the subject phoneme data from the phoneme data memory 20 (step S105). Thereafter, the speech synthesis control circuit 22 calculates a speech envelope signal $V_m$, by the following computation with the standardized frame power $P_n$, the mean frame power $G_f$, and the frame power correction value Gs stored in the built-in register G. The speech synthesis control circuit 22 then supplies the speech envelope signal $V_m$ to an amplitude adjustment circuit 25 (step S106).

$$V_m=\sqrt{P_n/(G_s G_f)}$$

By means of the step S106, the amplitude adjustment circuit 25 adjusts the amplitude of the speech waveform signal $V_f$ supplied from the vocal tract filter 24 to a level corresponding to the above-mentioned speech envelope signal $V_m$. Since the connecting portions of respective phonemes are always maintained at a predetermined level through this amplitude adjustment, the connection of phonemes becomes smooth and hence, natural sounding synthesized speech is produced.

Subsequently, the speech synthesis control circuit 22 determines whether the frame number n stored in the built-in register n is smaller than the total number of frames in the subject phoneme data N by 1, that is, whether the frame number n equals (N−1) (step S107). In the step S107, if it is determined that n does not equal (N−1), the speech synthesis control circuit 22 adds "1" to the frame number stored in the built-in register n, and stores this value as a new frame number in the built-in register n by substitution (step S108). After the step S108, the speech synthesis control circuit 22 returns to the step S103, and then repeats the above-mentioned operation.

On the other hand, in step S107, if it is determined that the frame number n stored in the built-in register n does not equal (N−1), the speech synthesis control circuit 22 returns to the step S101, and repeats the phonemic synthesis process to next phoneme data in the same manner.

The present invention has been explained heretofore in conjunction with the preferred embodiment. However, it should be understood that those skilled in the art could easily conceive various other embodiments and modifications and that such embodiments and modifications fall within the scope of the appended claims.

What is claimed is:

1. A method for synthesizing speech with an apparatus comprising a sound source for generating a frequency signal, a vocal tract filter for filtering said frequency signal to generate a speech waveform signal, said filter having characteristics corresponding to a linear predictive coefficient calculated from respective phonemes in a phoneme series, comprising the steps of:

inputting the phoneme series into the apparatus;

dividing each of said phonemes into N frames, each of said N frames having a predetermined time length;

summing squares of speech samples in each of said N frames as a frame power value for each frame, respectively;

standardizing frame power values at head and tail frames in one phoneme to predetermined values, respectively, to obtain a standardized frame power value of an n-th frame, wherein (1<n<N);

summing squares of signal levels of an n-th frame in said frequency signal to obtain a frame power correction value for the n-th frame; and calculating a speech envelope signal by means of a function comprising variables of said standardized frame power value of the n-th frame and said frame power correction value for the n-th frame, and outputting an amplitude adjusted waveform signal by adjusting an amplitude level of said speech waveform signal based on the speech envelope signal.

2. A method according to claim 1, further comprising:

providing power frequency characteristics based on said linear predictive coefficient corresponding to said n-th frame, and calculating an average value of power values sampled from said power frequency characteristics at a predetermined frequency interval as a mean frame power value for the n-th frame, wherein the function further comprises a variable of said mean frame power value for the n-th frame.

3. A method according to claim 2, wherein said function is expressed;

$$V_m=\sqrt{P_n/(G_s G_f)}$$

wherein $P_n$ is said standardized frame power value for the n-th frame, $G_s$ is said frame power correction value for the n-th frame, and $G_f$ is said mean frame power value for the n-th frame.

4. A method according to claim 1, wherein said frequency signal includes an impulse signal carrying a voiced sound and a noise signal carrying an unvoiced sound.

5. The method according to claim 1, wherein the standardized frame power value of an n-th frame is expressed;

$$P_n=P_c/[(1-r)\times P_a+r\times P_b];$$

wherein r=(n−1)/N;

wherein $P_c$ is the frame power value for the n-th frame, $P_a$ is the head frame power value and $P_b$ is the tail frame power value.

6. The method according to claim 1, wherein the phoneme is a string comprising at least one consonant C and at least one vowel V.

7. The method according to claim 6, wherein the string is one of CV, CVC and VCV.

* * * * *